United States Patent [19]

Smiley

[11] Patent Number: 4,826,105

[45] Date of Patent: May 2, 1989

[54] MISSILE FIN UNFOLDING DEVICE

[75] Inventor: Talt T. Smiley, Canal Winchester, Ohio

[73] Assignee: Rockwell International Corporation, El Segundo, Calif.

[21] Appl. No.: 153,129

[22] Filed: Feb. 8, 1988

[51] Int. Cl.[4] ..... B64C 3/56

[52] U.S. Cl. ..... 244/49; 244/118.1; 244/137.4; 244/3.27

[58] Field of Search ..... 244/46, 49, 218, 118.1, 244/130, 137.1, 137.4, 3.24, 3.27, 3.28, 3.29; 89/1.54, 1.59, 1.802, 1.015, 1.816

[56] References Cited

U.S. PATENT DOCUMENTS

| | | | |
|---|---|---|---|
| 2,876,677 | 3/1959 | Clark et al. | 244/49 |
| 3,063,375 | 11/1962 | Hawley et al. | 244/49 |
| 4,441,674 | 4/1984 | Holtrop | 244/137.4 |
| 4,568,044 | 2/1986 | DiTommaso et al. | 244/49 |
| 4,667,899 | 5/1987 | Wedertz | 244/49 |
| 4,781,342 | 11/1988 | Hardy et al. | 244/118.1 |

*Primary Examiner*—Sherman D. Basinger
*Assistant Examiner*—Stephen P. Avila
*Attorney, Agent, or Firm*—Charles T. Silberberg; Harold C. Weston

[57] ABSTRACT

A control surface deployment mechanism allows reliable, controlled launch of guided missiles from internal bays of high performance aircraft.

5 Claims, 2 Drawing Sheets

MISSILE FIN UNFOLDING DEVICE

BACKGROUND OF THE INVENTION

The present invention relates to devices used for deployment of foldable control surfaces of air launched missiles, and more particularly, to a totally passive means for deployment of folded fins employing cam tracks and track follower pins, with uni-directional travel restraint mechanical switches.

Use of high performance military aircraft as weapons platforms poses a number of problems related to efficient transport and reliable launch of guided missiles therefrom. Most such guided missiles depend on airfoil surfaces for stability and control functions, but these are generally spatially extensive and consume inordinate amounts of rack space and storage volume. Preservation of space and volume is best achieved with such surfaces folded or compressed until launch. Once the missile is free of the storage area or pod, it's control surfaces are deployed to their operational position.

To provide for carriage and launch of a maximum number of such missiles, bulky, extensive control surfaces are often folded or compressed and deployed as the missiles clear the launching aircraft. Reliable mechanisms in both the missile and launching aircraft are required to effect this surface deployment, and the within disclosure presents an aircraft mounted version thereof.

Known as a "fin unfolding device", it is comprised of a metal or plastic plate with slots having J-shaped portions within which ride follower pins attached to folded control surfaces of the missile. Vertical motion of the missile during launch, causes such pins to deploy the folded surfaces in a reliable manner while machanical switches in the slots close after passage of the pins to prevent their travel back up the tracks.

SUMMARY OF THE INVENTION

The within invention relates to a mechanical device that provides positive, mechanical deployment of folded control fins of missiles launched from wing pylons or weapons bays of high performance aircraft. The device was designed to be light weight, highly reliable and independent of support systems for proper operation. Fin deployment is carried out by a track following guide pin on the folded fin which, in turn, is caused to move with movement of the missile on which the fin is installed. The system uses no external power for operation, and unplanned deployment is mechanically prevented by cam follower pins, part of the folded fins, and mechanical switches in the cam tracks to prevent reverse travel of the cam follower pins Locking means incorporated into the missile airframe (not part of this invention) must be of such design that the fin is held securely in its deployed position after unfolding. The within invention is premised on either a "forced" ejection launch, or else a gravity controlled drop from a frame internal to a weapons bay of the launching aircraft.

It is primary objective of the within invention to provide a highly reliable, light weight, missile control surface unfolding mechanism providing space and volume conservation for launchable missiles, prior to launch.

Another objective is to provide a mechanical means to deploy stowed or folded aero-surfaces of missiles carried internally by high performance aircraft.

DETAILED DESCRIPTION OF THE PREFERRED EMBODIMENT

Figure 1:
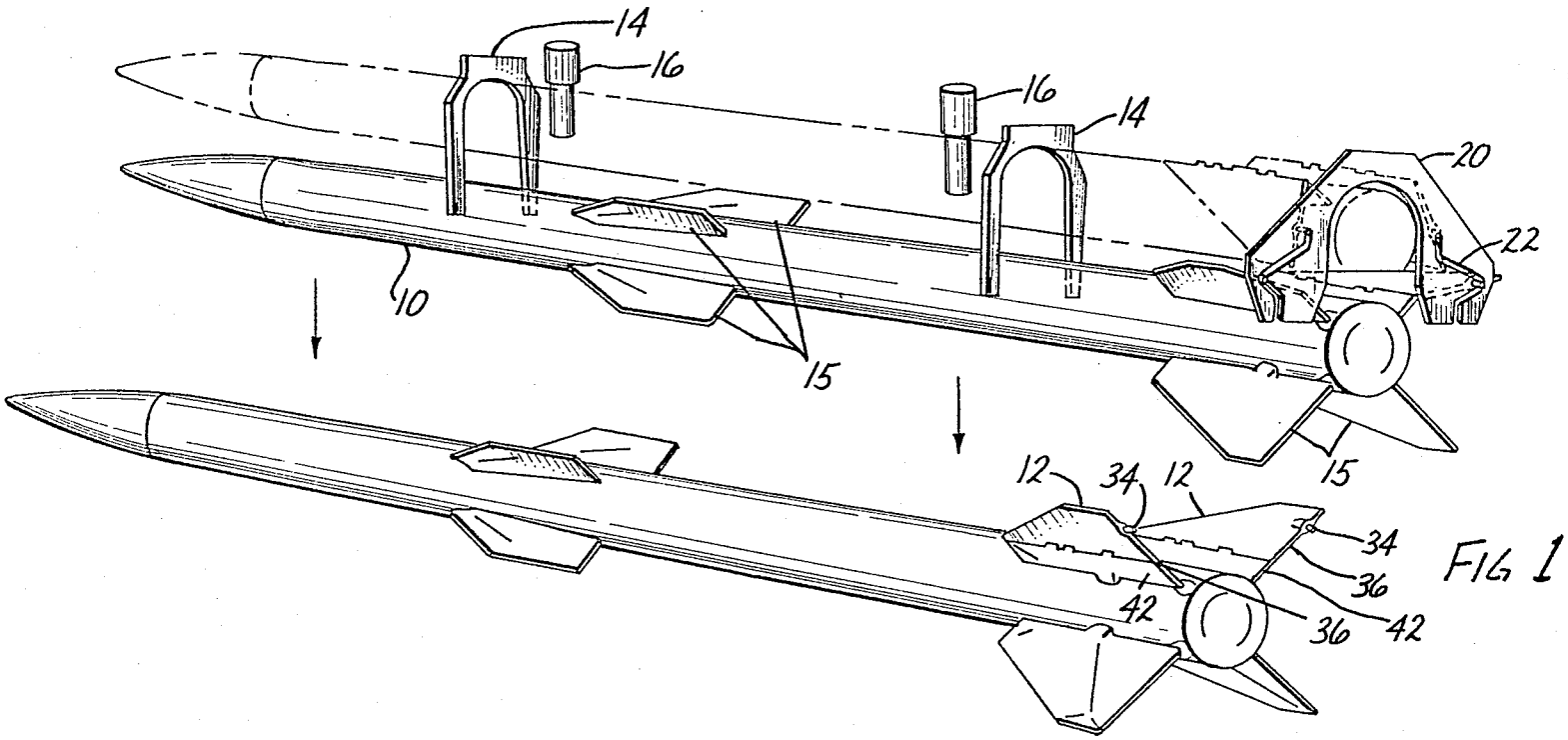
FIG. 1 is a sequential perspective view of a typical missile being launched from a weapons bay, showing the fin unfolding mechanism of this invention.
Figure 2D:
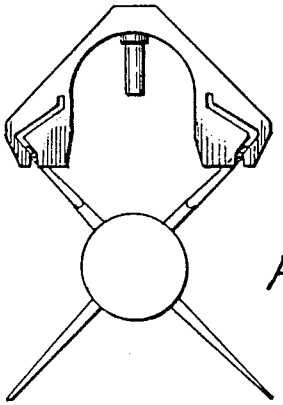
FIG. 2A–2D each are a cross sectional, in sequence, view of the missile being launched, showing the effect of the J-track on its originally folded control fins.
Figure 2C:
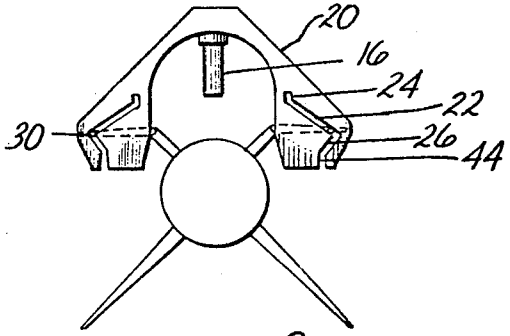
Figure 2B:
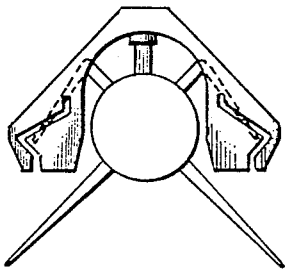
Figure 2A:
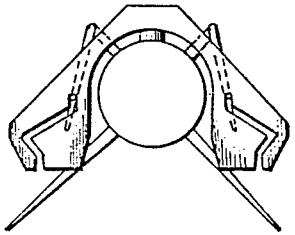
Figure 3:
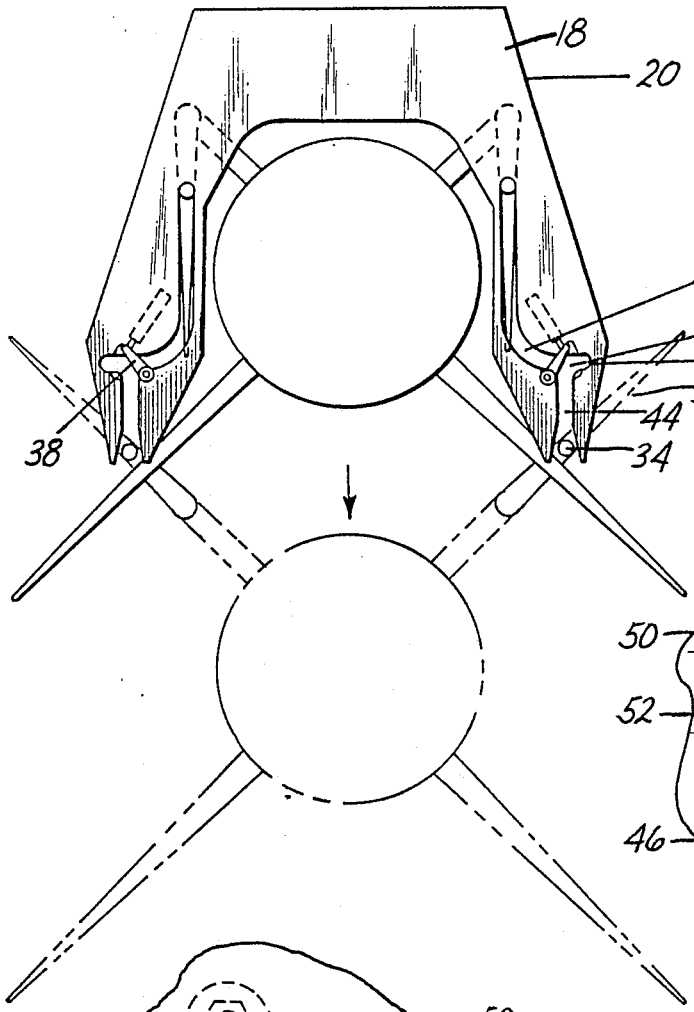
FIG. 3 is a cross section view of the fin unfolding mechanism with its mechanical switch.
Figure 4A:
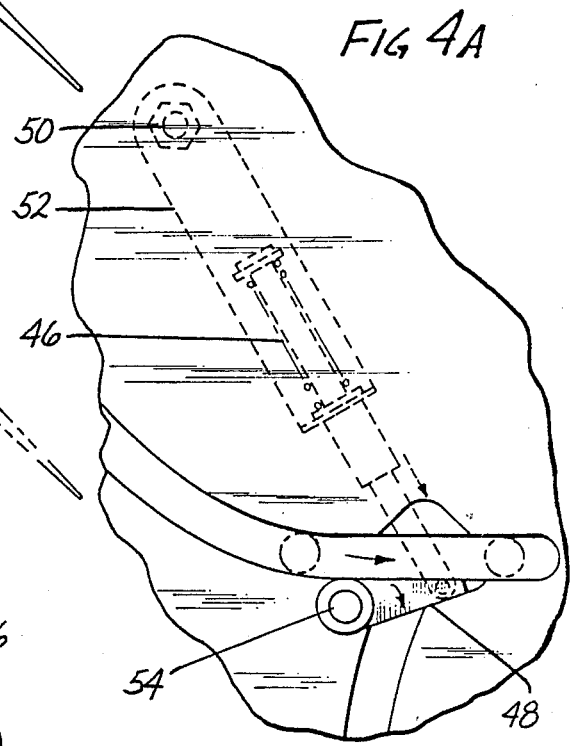
FIGS. 4A and 4B illustrate operation of the mechanical switch of the disclosed mechanism.
Figure 4B:
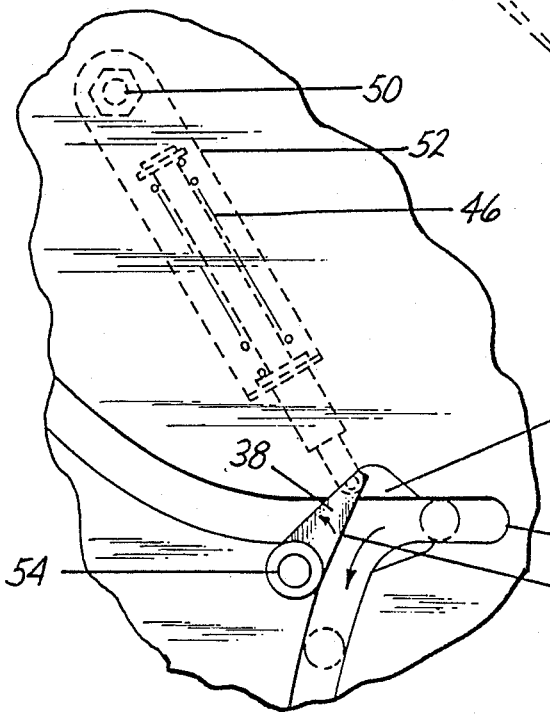

FIG. 1 presents a typical application of the preferred embodiment of this invention. In that application, a missile 10 with folded tail fins 12 is launched from an aircraft weapons bay along guide rails 14. Fixed fins 15 are not involved with this invention although any number of folded fins can be accommodated by the invention, with minor modifications.

Launch is initiated by means not part of this invention but which might be explosive bolts, solenoid actuated pin retractors or any suitable device used to separate the missile from its carrier tie down or securement position.

At initiation of launch, a forcing function device such as hydraulic or pneumatic plunger system 16, imparts vertical velocity to the missile proper. Travel of missile 10 is controlled by guide rails 14 along either side thereof. At the aft end of the weapons bay, fixed to aircraft structure, is the slotted deployment mechanism 20 of this invention. Mechanism 20 comprises a rigid plate 18 of metal or plastic, with curved or slanted slots 22 cut therein. Slot 22 can be designed with an initial vertical section 24 followed by arcs of curvature or straight slanted sides 26 of a given character. For most launcher configurations, slot 22 will be of the J-type, with a mechanical blocking switch 28 located at, or slightly above, its maximum horizontal width point 30.

Missile 10 is stowed in the bay with control fins 12 folded. Figures herein show a missile with two of its four fins folded, but variations of this invention can deploy one folded fin or as many thereof as can be accommodated by separate J-slots.

Each of folded fins 12 has a pin 34 affixed at a position along the trailing edge of hinged section 36. Pin 34 follows slot 22 in base plate 18 by reason of forces exerted by edges 26 thereon as missile 10 drops vertically between rails 14.

At the point of maximum outboard horizontal excursion 30 of pin 34, folded portion 36 of fin 12 will be horizontal, and this point is selectable by design, based on stress analysis of pin and fin structure and dynamics of the launch environment. As pin 34 passes inflection point 30, it changes direction of its horizontal excursion and continues to force folded fin portion 36 into alignment with fixed portion 42 thereof.

As pin 34 passes inflection point 30, a mechanical switch 28 is activated, whereby pin 34 depresses its spring restrained lever arm 38. Lever arm 38 of switch 28 has spring 46 urging it upwards to a position across slot 22. When pin 34 has passed over lever arm 38, spring 46 urges the arm upwards and brings surface 48 across slot 22, effectively blocking return travel of pin 34. Switch 28 has lever arm 38 pivoted at axle 54 and urged upwardly by spring 46 fixed to axle 50 of spring housing 52. Axles 50 and 54 are fixed to base plate 18. Spring 46 tension can be nominally small since its primary purpose is to bring surface 48 of lever arm 38 upwards across slot 22.

When folded surfaces 12 have been deployed, a variety of means, not part of this invention, can be used to secure them there. Spring loaded pins riding on ridges of the folded portion can be caused to seat themselves in sockets of the folded portion and a variety of other securement devices can be employed to insure stability of the deployed surface. With fins 12 fully extended, missile 10 continues its vertical travel, with pins 34 moving down the slot's second vertical section 44.

We claim:

1. In an aircraft having missiles detachably connected to the aircraft for ejection from the aircraft, the missiles having fins thereon, some of said missles having at least one fin in folded position, a missile fin unfolding device comprising a plate fixed to aircraft structure of the aircraft, a pin protruding from each of the fins in folded position, said plate having slots adapted to receive said pins of the folded fins of each missile, said plate shaped to provide lateral forces on said pins as the missile moves in a direction for ejection from the aircraft, said pins moving through said slots as the missile is moved for ejection, said slots acting to unfold the folded fins as the pins move through the slots.

2. The device of claim 1 wherein said slots are substantially of a J-shape to provide lateral force on said pins as the missile moves in a direction for ejection.

3. The device of claim 1 wherein a stop means is positioned across said slots allowing passage of the pins in one direction only, whereby when one of the missiles with folded fins is detached, it may only move in a direction for ejection.

4. The device of claim 1 wherein each pin is positioned inside of the outboard edge of the respective fin from which it protrudes.

5. The device of claim 1 wherein the missles are ejected in a direction parallel to the yaw axis of the aircraft.

* * * * *